US009339779B1

(12) United States Patent
Olson

(10) Patent No.: US 9,339,779 B1
(45) Date of Patent: May 17, 2016

(54) SHAKING DEVICE FOR MIXING NAIL POLISH

(71) Applicant: Steve C. Olson, Marina, CA (US)

(72) Inventor: Steve C. Olson, Marina, CA (US)

( * ) Notice: Subject to any disclaimer, the term of this patent is extended or adjusted under 35 U.S.C. 154(b) by 514 days.

(21) Appl. No.: 13/870,476

(22) Filed: Apr. 25, 2013

(51) Int. Cl.
*B01F 11/00* (2006.01)

(52) U.S. Cl.
CPC ..... *B01F 11/0022* (2013.01)

(58) Field of Classification Search
CPC ..... B01F 11/0031
USPC ..... 366/110–112, 209, 215–217
See application file for complete search history.

(56) References Cited

U.S. PATENT DOCUMENTS 523,587 A * 7/1894 Muller ..... A23C 15/02 366/208
584,549 A * 6/1897 Hutchinson ..... B01F 11/0017 248/128
982,156 A * 1/1911 Miltz ..... B01F 9/0025 366/216
3,030,082 A * 4/1962 Matzen ..... A47J 43/042 366/209
3,061,280 A 10/1962 Kraft et al.
3,128,082 A * 4/1964 Cline ..... A47J 43/042 366/110
3,331,588 A * 7/1967 Nasser ..... A45D 34/048 366/211
3,503,592 A * 3/1970 Taylor ..... B01F 11/0022 366/212
3,735,962 A * 5/1973 Pagano ..... B01F 11/0005 366/212
4,316,672 A 2/1982 Kerscher
D292,803 S 11/1987 Powell
4,893,938 A 1/1990 Anderson
5,273,357 A 12/1993 Currie
5,971,599 A * 10/1999 Bothers ..... B01F 11/0022 366/110
2002/0110046 A1* 8/2002 Robertson ..... B01F 11/0005 366/110
2013/0003487 A1* 1/2013 Ballard ..... 366/110
2014/0126321 A1* 5/2014 Eisen ..... B01F 15/00409 366/213

* cited by examiner

*Primary Examiner* — David Sorkin

(57) ABSTRACT

A shaking device for mixing nail polish mixes bottles of nail polish prior to use in order to achieve a uniform mixing of contents in the bottle. The shaking device includes a housing having a top side, a bottom side, and a peripheral wall extending between the top and bottom sides. A frame is mounted in an interior of the housing. A primary shaft is coupled to the frame. A container is coupled to the primary shaft and has an interior space configured for holding an object to be shaken. A motor is coupled to the frame. The motor is mechanically coupled to the primary shaft wherein actuation of the motor causes movement of the primary shaft and vibrates the object held in the container.

18 Claims, 6 Drawing Sheets

SHAKING DEVICE FOR MIXING NAIL POLISH

BACKGROUND OF THE DISCLOSURE

Field of the Disclosure

The disclosure relates to shaking devices and more particularly pertains to a new shaking device for mixing bottles of nail polish prior to use in order to achieve a uniform mixing of contents in the bottle.

SUMMARY OF THE DISCLOSURE

An embodiment of the disclosure meets the needs presented above by generally comprising a housing having a top side, a bottom side, and a peripheral wall extending between the top and bottom sides. A frame is mounted in an interior of the housing. A primary shaft is coupled to the frame. A container is coupled to the primary shaft and has an interior space configured for holding an object to be shaken. A motor is coupled to the frame. The motor is mechanically coupled to the primary shaft wherein actuation of the motor causes movement of the primary shaft and vibrates the object held in the container.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
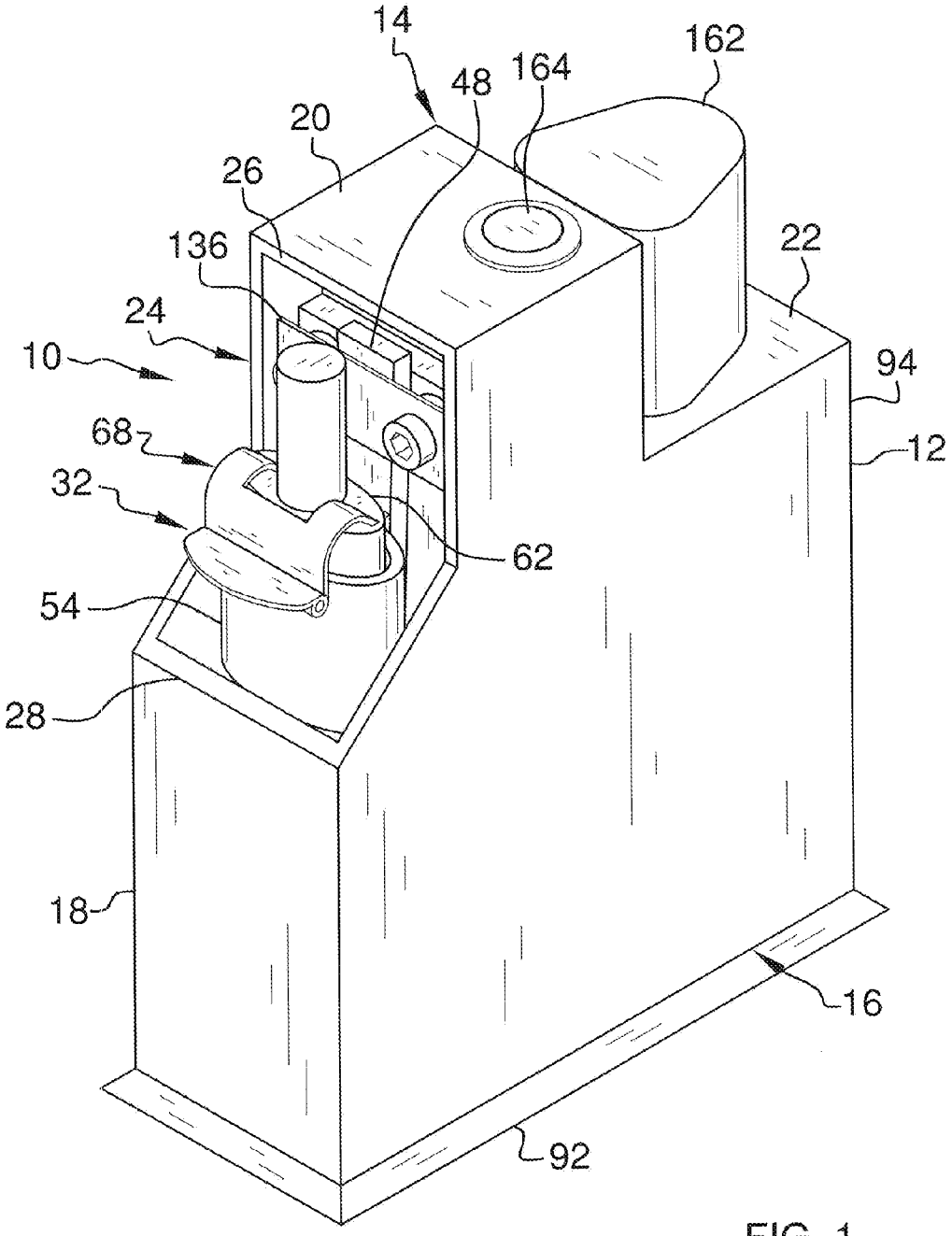
FIG. 1 is a top front side perspective view of a shaking device for mixing nail polish according to an embodiment of the disclosure.
Figure 2:
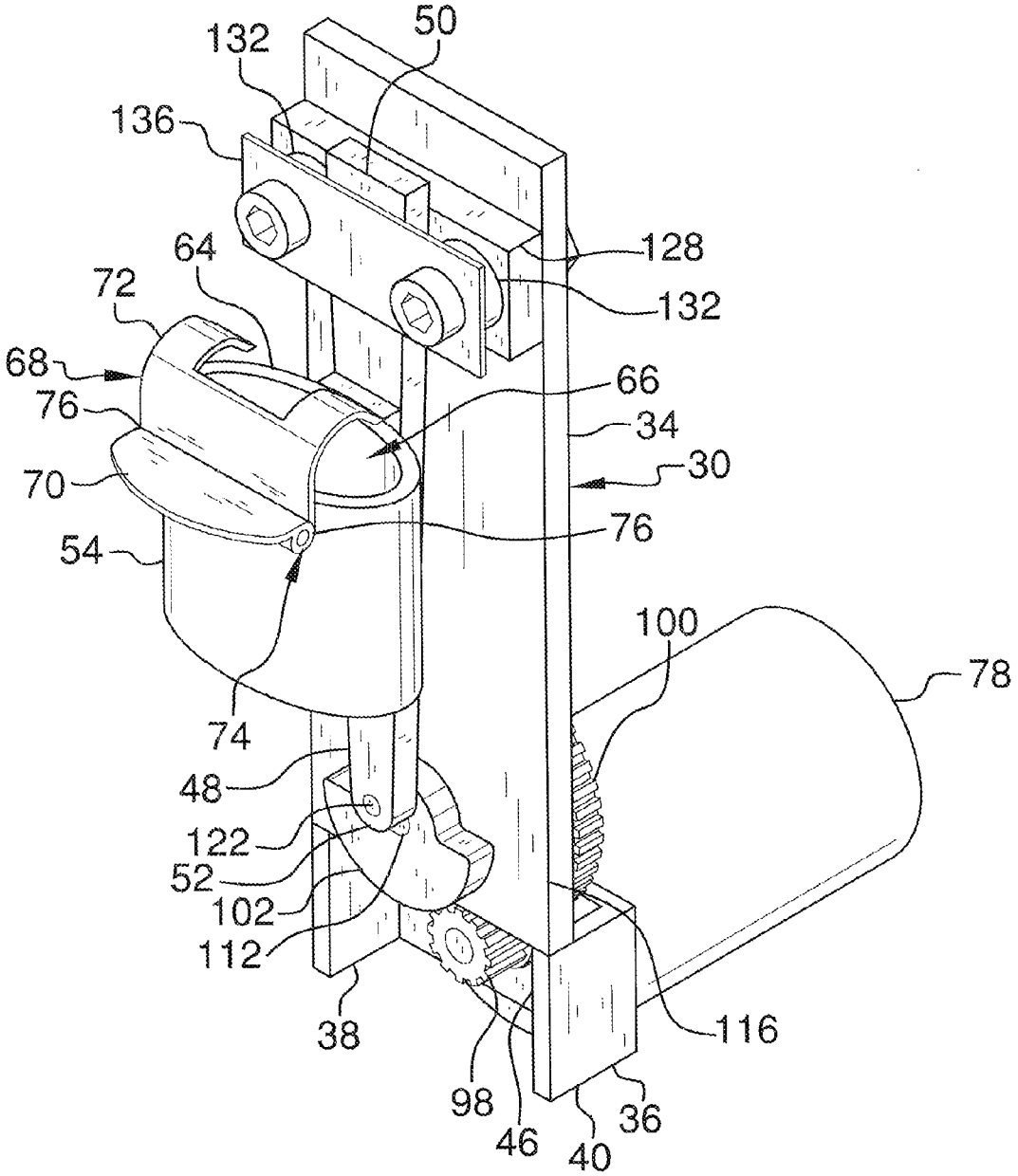
FIG. 2 is a top front side perspective view of an embodiment of the disclosure.
Figure 3:
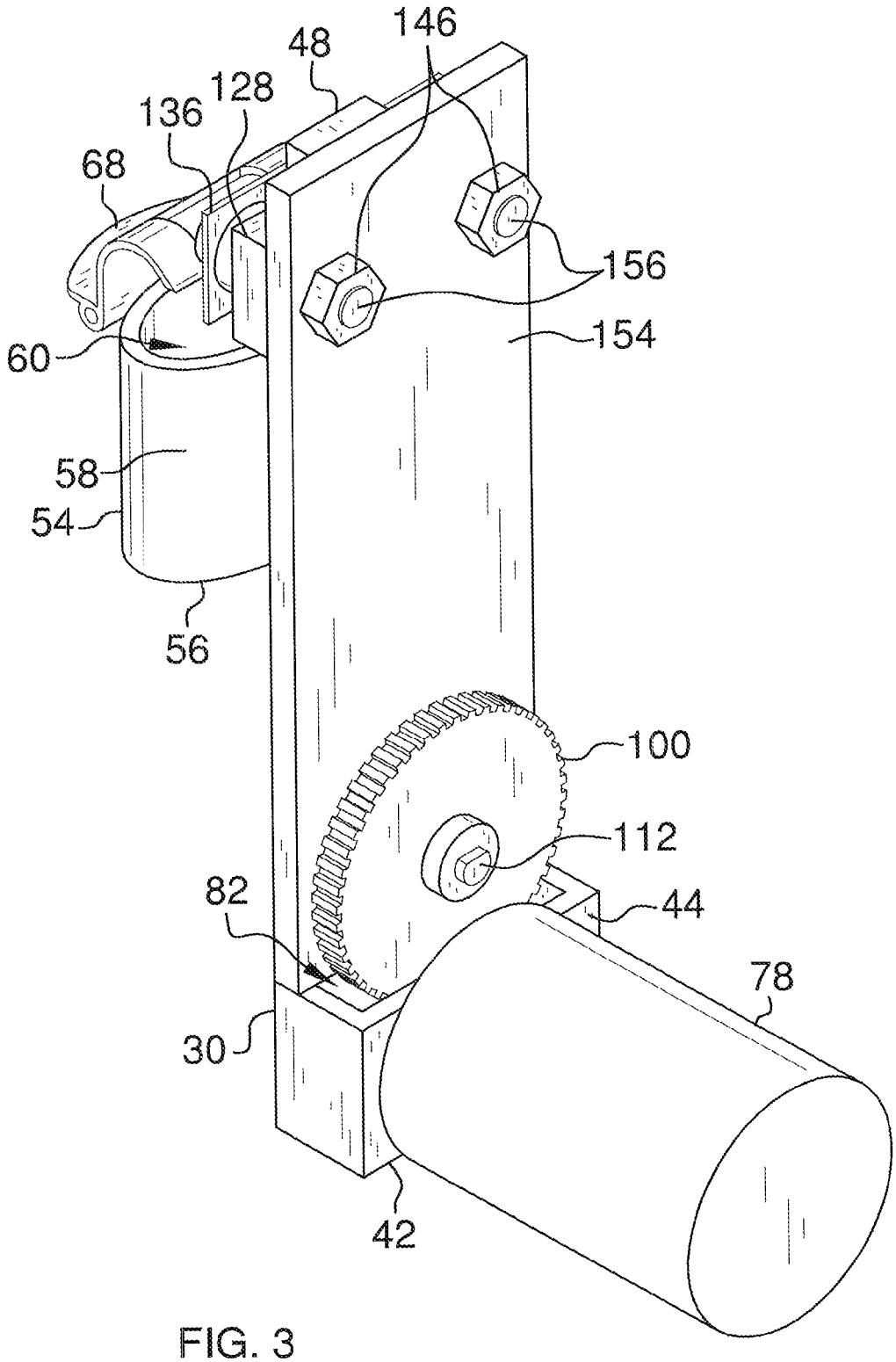
FIG. 3 is a top back side perspective view of an embodiment of the disclosure.
Figure 4:
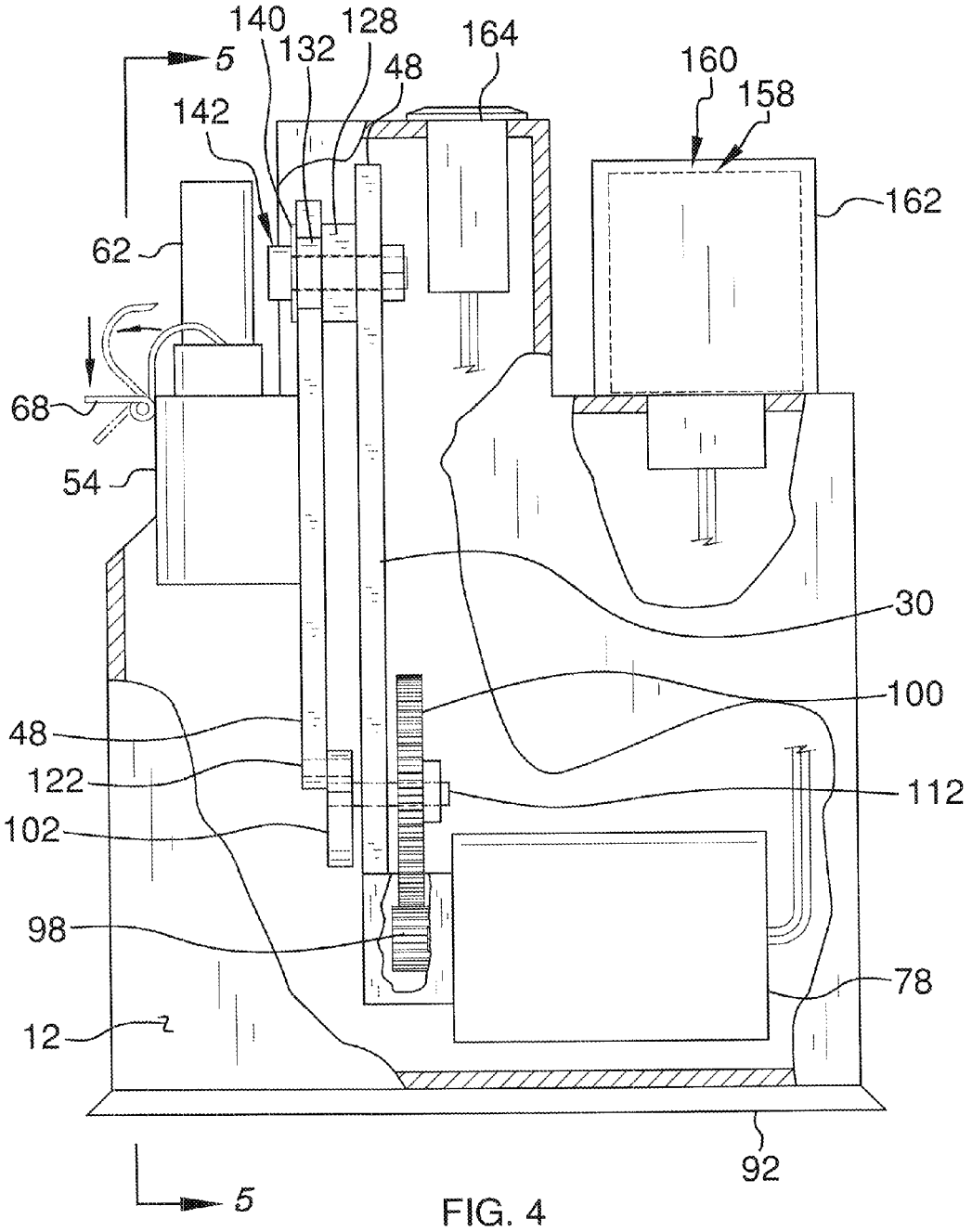
FIG. 4 is a partial cut-away side view of an embodiment of the disclosure.
Figure 5:
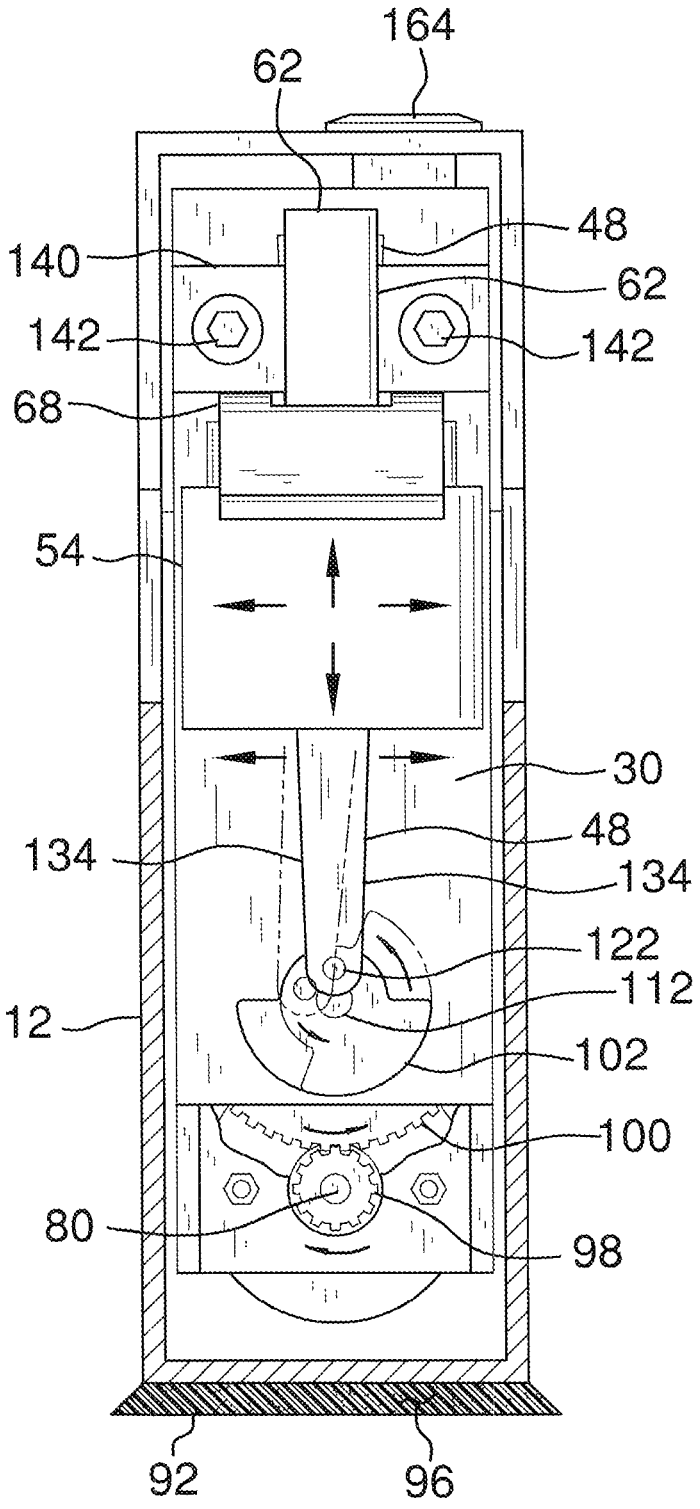
FIG. 5 is a cross-sectional view of an embodiment of the disclosure taken along line 5-5 of FIG. 4.
Figure 6:
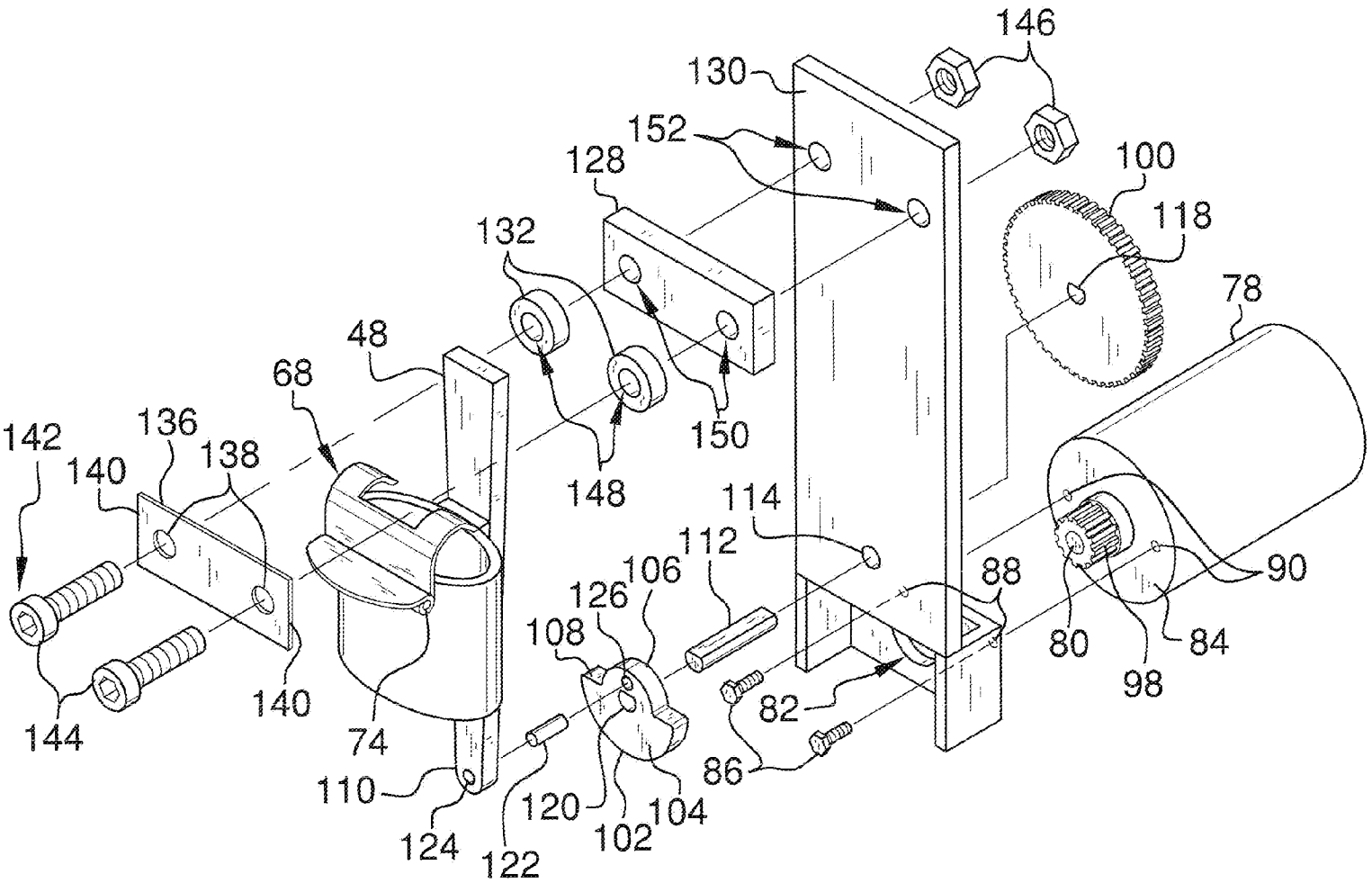
FIG. 6 is a partially-exploded top front side perspective view of an embodiment of the disclosure.

With reference now to the drawings, and in particular to FIGS. 1 through 6 thereof, a new shaking device embodying the principles and concepts of an embodiment of the disclosure and generally designated by the reference numeral 10 will be described.

As best illustrated in FIGS. 1 through 6, the shaking device for mixing nail polish 10 generally comprises a housing 12 having a top side 14, a bottom side 16, and a peripheral wall 18 extending between the top 14 and bottom 16 sides. The top side 14 may have a first surface 20 offset from a second surface 22 wherein the first surface 20 is elevated relative to the second surface 22. An opening 24 preferably extends downwardly from a first side 26 of the first surface 20 to a first side 28 of the housing 12. The housing 12 is preferably small and compact to facilitate portability of the device 10. The housing 12 is made from plastic or other similar material. A frame 30 is mounted in an interior 32 of the housing 12. The frame 30 has an upper portion 34 and a lower portion 36. The upper portion 34 is preferably elongated. The lower portion 36 has a first side 38 spaced from a second side 40, The frame 30 has a medial portion 42 extending between a first end 44 of each of the first 38 and second 40 sides of the frame 30. The upper portion 34 may extend upwardly from a second end 46 of each of the first 38 and second 40 sides of the frame 30.

A primary shaft 48 is coupled to the frame 30. The primary shaft 48 has a top end 50 and a bottom end 52. The primary shaft 48 preferably tapers from the top end 50 to the bottom end 52. The bottom end 52 may be arcuate. The primary shaft 48 is made from aluminum or similar material. A container 54 is coupled to the primary shaft 48. The container 54 has a bottom wall 56 and a perimeter wall 58 extending upwardly from the bottom wall 56. The container 54 is preferably cup-shaped. The container 54 has an interior space 60 configured for holding an object 62 to be shaken. The container 54 is preferably designed to hold and shake a bottle of nail polish 62, though other objects 62 are within the scope of the invention and may be positioned within the container 54 and shaken. A top edge 64 of the perimeter wall 58 defines an opening 66 into the interior space 60.

A cover 68 is coupled to the container 54. The cover 68 has a first member 70 coupled to a second member 72. The first member 70 is coupled to the perimeter wall 58 of the container 54. The second member 72 is positionable over the opening 66 of the container 54 such that the second member 72 secures the object 62 within the interior space 60 of the container 54 when the object 62 is positioned in the container 54 and the second member 72 is positioned to abut the object 62. The second member 72 may be arcuate. Each of the first 70 and second 72 members are preferably made from plastic or similar material, A pair of biasing members 74 is preferably positioned in the cover 68 wherein the biasing members 74 are configured to bias the cover 68 over the opening 66 of the container 54. Each of the biasing members 74 may be positioned on opposite ends 76 of the cover 68 at a juncture between the first member 70 and the second member 72.

A motor 78 is coupled to the frame 30. The motor 78 is mechanically coupled to the primary shaft 48 wherein actuation of the motor 78 causes movement of the primary shaft 48 and vibration of the object 62 held in the container 54. A motor shaft 80 is coupled to and extends outwardly from the motor 78. The motor shaft 80 may extend through an opening 82 in the medial portion 42 of the frame 30. The motor shaft 80 may be positioned on a first side 84 of the motor 78. A first pair of fasteners 86 couples the frame 30 to the motor 78. Each of the first pair of fasteners 86 extends through a first pair of holes 88 positioned in the medial portion 42 of the frame 30 and further through a second pair of holes 90 positioned on the first side 84 of the motor 78. A pad 92 may be coupled to the bottom side 16 of the housing 12 and extend between the first side 28 and a second side 94 of the housing 12. The pad 92 may be comprised of a resiliently compressible material 96 wherein the pad 92 is configured for controlling vibration of the housing 12.

A first gear 98 is coupled to the motor shaft 80. The first gear 98 is mechanically coupled to the motor 78 wherein actuation of the motor 78 rotates the first gear 98. A second gear 100 is coupled to the frame 30. The second gear 100 is mechanically coupled to the first gear 98 wherein rotation of the first gear 98 causes the second gear 100 to rotate. The second gear 100 is preferably larger in size than the first gear 98. A counterweight 102 may be coupled to the primary shaft 48 and the frame 30 wherein the counterweight 102 is configured to control vibration of the container 54. The counterweight 102 has a main portion 104 and a projection 106, Each of the main portion 104 and the projection 106 may be arcuate. The projection 106 may be coupled to and extend upwardly from a top edge 108 of the main portion 104. The counterweight 102 is preferably coupled to a bottom portion 110 of the primary shaft 48. The counterweight 102 is mechanically coupled to the second gear 100 and the primary shaft 48 wherein rotation of the second gear 100 causes rotation of the counterweight 102 and movement of the primary shaft 48.

A first pin 112 couples the counterweight 102 to the second gear 100. The first pin 112 extends through an aperture 114 positioned in a lower end 116 of the upper portion 34 of the flame 30 and further extends through a central aperture 118 positioned in the second gear 100 and a bottom aperture 120 positioned in the counterweight 102. A second pin 122 couples the primary shaft 48 to the counterweight 102, The second pin 122 extends through an aperture 124 positioned in the bottom portion 110 of the primary shaft 48 and further extends through an upper aperture 126 positioned in the counterweight 102. Each of the first 112 and second 122 pins may be made from steel or other similar material.

A panel 128 is coupled to the frame 30. The panel 128 is positioned between the primary shall 48 and a first side 130 of the frame 30 wherein the panel 128 is configured to provide space between the primary shaft 48 and the frame 30. A pair of rollers 132 is coupled to the panel 128. Each of the rollers 132 is preferably positioned on opposite sides 134 of the primary shaft 48 wherein the rollers 132 are configured for retaining the primary shaft 48 in place when the primary shaft 48 moves up and down. A plate 136 is coupled to the primary shaft 48 and the rollers 132 wherein the plate 136 is configured to retain the primary shaft 48 in place when the primary shaft 48 moves up and down. The plate 136 has a pair of holes 138 positioned therein. Each of the holes 138 in the plate 136 is positioned on opposite ends 140 of the plate 136. A second pair of fasteners 142 is provided. Each of the second pair of fasteners 142 comprises an extending member 144 and a retaining member 146. The extending members 144 extend through the holes 138 in the plate 136. Each of the extending members 144 further extends through holes 148 positioned in each of the rollers 132, through holes 150 positioned in the panel 128, and through upper holes 152 positioned in the upper portion 34 of the frame 30. Each of the retaining members 146 is positionable to abut a second side 154 of the frame 30 and a second end 156 of the extending members 144.

A power source 158 is coupled to the housing 12 wherein the power source 158 comprises a battery 160. The battery 160 may be a 12 Volt battery or a battery of similar voltage. The power source 158 is electrically coupled to the motor 78 wherein the power source 158 delivers power to actuate the motor 78. A compartment 162 is coupled to the housing 12. The compartment 162 may extend upwardly from the second surface 22 of the housing 12, The power source 158 is mounted in the compartment 162. A timer switch 164 is preferably mounted to the housing 12. The timer switch 164 is electrically coupled to the motor 78 and the power source 158 wherein selective manipulation of the timer switch 164 actuates the motor 78 for a pre-determined period of time. Preferably, the timer switch 164 turns on the motor 78 for thirty seconds so as to evenly distribute the contents of the object 62, such as nail polish, that is held in the container 54. However, it is contemplated that this period of time may be longer or shorter depending on the particular object 62 to be shaken. An on/off switch may be provided and be electrically coupled to the power source 158 to selectively provide power to the device 10 when manipulated.

The housing 12 has a width between approximately 1 centimeter and 10 centimeters, a length between approximately 8 centimeters and 20 centimeters, and a height between approximately 9 centimeters and 22 centimeters. The pad 92 has a length between approximately 5 centimeters and 20 centimeters.

In use, as stated above and shown in the Figures, an object 62, such as a bottle of nail polish, is positioned in the container 54. The cover 68 is positioned over the opening 66 of the container 54 such that the object 62 is securely retained within the interior space 60 of the container 54. The timer switch 164 is then manipulated in order to shake the object 62 for a pre-determined period of time, such as thirty seconds. After the pre determined period of time elapses, the object 62 is removed from the container 54 and then used. The device 10 has particular application in nail salons, spas, or the like since the device 10 can be used to automatically shake a bottle of nail polish 62.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A shaking device for mixing nail polish comprising:

a housing having a top side, a bottom side, and a peripheral wall extending between said top and bottom sides;

a frame mounted in an interior of said housing, said frame having an upper portion and a lower portion, said upper portion being elongated, said lower portion having a first side spaced from a second side, said frame having a medial portion extending between a first end of each of said first and second sides of said frame, said upper portion extending upwardly from a second end of each of said first and second sides of said frame;

a primary shaft coupled to said frame;

a container coupled to said primary shaft, said container having an interior space configured for holding an object to be shaken;

a motor coupled to said frame, said motor being mechanically coupled to said primary shaft wherein actuation of said motor causes movement of said primary shaft and vibrates the object held in said container;

a motor shaft coupled to and extending outwardly from said motor, said motor shaft extending through an opening in said medial portion of said frame, said motor shaft being positioned on a first side of said motor; and a first gear coupled to said motor shaft, said first gear being mechanically coupled to said motor wherein actuation of said motor rotates said first gear.

2. The device of claim 1, further comprising a pad coupled to said bottom side of said housing, said pad extending between a first side and a second side of said housing, said pad being comprised of a resiliently compressible material wherein said pad is configured for controlling vibration of said housing.

3. The device of claim 1, further comprising:

said container having a bottom wall and a perimeter wall extending upwardly from said bottom wall;

a top edge of said perimeter wall defining an opening into said interior space; and a cover coupled to said container, said cover having a first member coupled to a second member, said first member being coupled to said perimeter wall of said container, said second member being positionable over said opening of said container such that said second member secures the object within said interior space of said container when the object is positioned in said container and said second member is positioned to abut the object.

4. The device of claim 3, further comprising a pair of biasing members being positioned in said cover wherein said biasing members are configured to bias said cover over said opening of said container, each of said biasing members being positioned on opposite ends of said cover at a juncture between said first member and said second member.

5. The device of claim 1, further comprising a first pair of fasteners coupling said frame to said motor, each of said first pair of fasteners extending through a first pair of holes positioned in said medial portion of said frame and further extending through a second pair of holes positioned on a first side of said motor.

6. The device of claim 1, further comprising a second gear coupled to said frame, said second gear being mechanically coupled to said first gear wherein rotation of said first gear causes said second gear to rotate, said second gear being larger in size than said first gear.

7. The device of claim 6, further comprising a counterweight coupled to said primary shaft and said frame wherein said counterweight is configured to control vibration of said container, said counterweight being mechanically coupled to said second gear and said primary shaft wherein rotation of said second gear causes rotation of said counterweight and movement of said primary shaft.

8. The device of claim 7, further comprising:

a first pin coupling said counterweight to said second gear, said first pin extending through an aperture positioned in a bottom portion of said upper portion of said frame and further extending through a central aperture positioned in said second gear and a bottom aperture positioned in said counterweight; and a second pin coupling said primary shaft to said counterweight, said second pin extending through an aperture positioned in a lower end of said primary shaft and further extending through an upper aperture positioned in said counterweight.

9. The device of claim 1, further comprising a panel coupled to said frame, said panel being positioned between said primary shaft and a first side of said frame wherein said panel is configured to provide space between said primary shaft and said frame.

10. The device of claim 9, further comprising:

a pair of rollers coupled to said panel, each of said rollers being positioned on opposite sides of said primary shaft wherein said rollers are configured for retaining said primary shaft in place when said primary shaft moves up and down; and a plate coupled to said primary shaft and said rollers wherein said plate is configured to retain said primary shaft in place when said primary shaft moves up and down.

11. A shaking device for mixing nail polish comprising:

a housing having a top side, a bottom side, and a peripheral wall extending between said top and bottom sides;

a frame mounted in an interior of said housing;

a primary shaft coupled to said frame;

a container coupled to said primary shaft, said container having an interior space configured for holding an object to be shaken;

a motor coupled to said frame, said motor being mechanically coupled to said primary shaft wherein actuation of said motor causes movement of said primary shaft and vibrates the object held in said container;

a panel coupled to said frame, said panel being positioned between said primary shaft and a first side of said frame wherein said panel is configured to provide space between said primary shaft and said frame;

a pair of rollers coupled to said panel, each of said rollers being positioned on opposite sides of said primary shaft wherein said rollers are configured for retaining said primary shaft in place when said primary shaft moves up and down; and a plate coupled to said primary shaft and said rollers wherein said plate is configured to retain said primary shaft in place when said primary shaft moves up and down, said plate having a pair of holes positioned therein, each of said holes in said plate being positioned on opposite ends of said plate; and a second pair of fasteners, each of said second pair of fasteners comprising an extending member and a retaining member, said extending members extending through said holes in said plate, each of said extending members further extending through holes positioned in each of said rollers, through holes positioned in said panel, and through upper holes positioned in an upper portion of said frame, each of said retaining members being positionable to abut a second side of said frame and a second end of said extending members.

12. The device of claim 1, further comprising a power source coupled to said housing, said power source being electrically coupled to said motor wherein said power source delivers power to actuate said motor.

13. The device of claim 12, further comprising a timer switch mounted to said housing, said timer switch being electrically coupled to said motor and said power source wherein selective manipulation of said timer switch actuates said motor for a pre-determined period of time.

14. The device of claim 12, further comprising a compartment coupled to said housing, said power source being mounted in said compartment.

15. The device of claim 14, further comprising:

said top side of said housing having a first surface offset from a second surface, said first surface being elevated relative to said second surface; and said compartment extending upwardly from said second surface of said housing.

16. The device of claim 12, further comprising wherein said power source comprises a battery.

17. The device of claim 7, further comprising said counterweight having a main portion and a projection, each of said main portion and said projection being arcuate, said projection being coupled to and extending upwardly from a top edge of said main portion, said counterweight being coupled to a bottom portion of said primary shaft.

18. A shaking device for mixing nail polish comprising:

a housing having a top side, a bottom side, and a peripheral wall extending between said top and bottom sides, said top side having a first surface offset from a second surface, said first surface being elevated relative to said second surface, an opening extending downwardly from a first side of said first surface to a first side of said housing;

a frame mounted in an interior of said housing, said frame having an upper portion and a lower portion, said upper portion being elongated, said lower portion having a first side spaced from a second side, said frame having a medial portion extending between a first end of each of said first and second sides of said frame, said upper portion extending upwardly from a second end of each of said first and second sides of said frame;

a pad coupled to said bottom side of said housing, said pad extending between said first side and a second side of said housing, said pad being comprised of a resiliently compressible material wherein said pad is configured for controlling vibration of said housing;

a primary shaft coupled to said frame, said primary shaft having a top end and a bottom end, said primary shaft tapering from said top end to said bottom end, said bottom end being arcuate;

a container coupled to said primary shaft, said container having a bottom wall and a perimeter wall extending upwardly from said bottom wall, said container having an interior space configured for holding an object to be shaken, a top edge of said perimeter wall defining an opening into said interior space;

a cover coupled to said container, said cover having a first member coupled to a second member, said first member being coupled to said perimeter wall of said container, said second member being positionable over said opening of said container such that said second member secures the object within said interior space of said container when the object is positioned in said container and said second member is positioned to abut the object, said second member being arcuate;

a pair of biasing members being positioned in said cover wherein said biasing members are configured to bias said cover over said opening of said container, each of said biasing members being positioned on opposite ends of said cover at a juncture between said first member and said second member;

a motor coupled to said frame, said motor being mechanically coupled to said primary shaft wherein actuation of said motor causes movement of said primary shaft and vibration of the object held in said container;

a motor shaft coupled to and extending outwardly from said motor, said motor shaft extending through an opening in said medial portion of said frame, said motor shaft being positioned on a first side of said motor;

a first pair of fasteners coupling said frame to said motor, each of said first pair of fasteners extending through a first pair of holes positioned in said medial portion of said frame and further through a second pair of holes positioned on said first side of said motor;

a first gear coupled to said motor shaft, said first gear being mechanically coupled to said motor wherein actuation of said motor rotates said first gear;

a second gear coupled to said frame, said second gear being mechanically coupled to said first gear wherein rotation of said first gear causes said second gear to rotate, said second gear being larger in size than said first gear;

a counterweight coupled to said primary shaft and said frame wherein said counterweight is configured to control vibration of said container, said counterweight having a main portion and a projection, each of said main portion and said projection being arcuate, said projection being coupled to and extending upwardly from a top edge of said main portion, said counterweight being coupled to a bottom portion of said primary shaft, said counterweight being mechanically coupled to said second gear and said primary shaft wherein rotation of said second gear causes rotation of said counterweight and movement of said primary shaft;

a first pin coupling said counterweight to said second gear, said first pin extending through an aperture positioned in said bottom portion of said upper portion of said frame and further extending through a central aperture positioned in said second gear and a bottom aperture positioned in said counterweight;

a second pin coupling said primary shaft to said counterweight, said second pin extending through an aperture positioned in a lower end of said primary shaft and further extending through an upper aperture positioned in said counterweight;

a panel coupled to said frame, said panel being positioned between said primary shaft and a first side of said frame wherein said panel is configured to provide space between said primary shaft and said frame;

a pair of rollers coupled to said panel, each of said rollers being positioned on opposite sides of said primary shaft wherein said rollers are configured for retaining said primary shaft in place when said primary shaft moves up and down;

a plate coupled to said primary shaft and said rollers wherein said plate is configured to retain said primary shaft in place when said primary shaft moves up and down, said plate having a pair of holes positioned therein, each of said holes in said plate being positioned on opposite ends of said plate;

a second pair of fasteners, each of said second pair of fasteners comprising an extending member and a retaining member, said extending members extending through said holes in said plate, each of said extending members further extending through holes positioned in each of said rollers, through holes positioned in said panel, and through upper holes positioned in said upper portion of said frame, each of said retaining members being positionable to abut a second side of said frame and a second end of said extending members;

a power source coupled to said housing wherein said power source comprises a battery, said power source being electrically coupled to said motor wherein said power source delivers power to actuate said motor;

a compartment coupled to said housing, said compartment extending upwardly from said second surface of said housing, said power source being mounted in said compartment; and a timer switch mounted to said housing, said timer switch being electrically coupled to said motor and said power source wherein selective manipulation of said timer switch actuates said motor for a pre-determined period of time.

* * * * *